US008656932B2

(12) United States Patent
Valadi

(10) Patent No.: US 8,656,932 B2
(45) Date of Patent: Feb. 25, 2014

(54) SMOKELESS CIGARETTE

(75) Inventor: Mahmood Valadi, Taby (SE)

(73) Assignee: Mahmood Valadi, Taby (SE)

( * ) Notice: Subject to any disclaimer, the term of this patent is extended or adjusted under 35 U.S.C. 154(b) by 1376 days.

(21) Appl. No.: 11/666,450

(22) PCT Filed: Jun. 21, 2005

(86) PCT No.: PCT/SE2005/000984

§ 371 (c)(1),
(2), (4) Date: Apr. 26, 2007

(87) PCT Pub. No.: WO2006/052177

PCT Pub. Date: May 18, 2006

(65) Prior Publication Data

US 2008/0000487 A1 Jan. 3, 2008

(30) Foreign Application Priority Data

Nov. 11, 2004 (SE) ..... 0402764

(51) Int. Cl.
*A24F 47/00* (2006.01)
*A24B 15/18* (2006.01)

(52) U.S. Cl.
USPC ..... 131/273

(58) Field of Classification Search
USPC ..... 131/273
See application file for complete search history.

(56) References Cited

U.S. PATENT DOCUMENTS 4,493,331 A * 1/1985 Porenski, Jr. ..... 131/336
5,293,883 A * 3/1994 Edwards ..... 131/270
5,331,979 A * 7/1994 Henley ..... 131/273
5,799,663 A * 9/1998 Gross et al. ..... 131/270
2006/0283468 A1* 12/2006 Lipowicz ..... 131/270

FOREIGN PATENT DOCUMENTS

| | | | |
|---|---|---|---|
| BE | 1012837 | A3 | 4/2001 |
| EP | 0321943 | A2 | 6/1989 |
| WO | WO 00/15055 | A2 | 3/2000 |

OTHER PUBLICATIONS

International Search Report for PCT/SE2005/000984 mailed Jan. 19, 2006.

* cited by examiner

*Primary Examiner* — Philip Tucker
*Assistant Examiner* — Vicki Wu
(74) *Attorney, Agent, or Firm* — Potomac Patent Group PLLC

(57) ABSTRACT

A smokeless cigarette for e.g. anti-smoke purposes includes a part that can deliver or distribute nicotine to the skin of a user. The cigarette includes a mouthpiece part having an inner porous body permeable to air, designed substantially as a filter of a filter cigarette. The front part that corresponds to the tobacco part of a filter cigarette can be made to include an inner portion of for example an air permeable material impregnated with a fragrant or refreshing substance. The inner bodies are secured to each other by and surrounded by a surface layer of a material that in a region in the mouthpiece part is impregnated with nicotine. The surface layer can have perforations in its area adjacent to the front part in the case where the inner portion of the front part of the cigarette is not permeable to air. Before use, the whole cigarette is enclosed by a thin protective film that has to be removed before use. By the impregnation with nicotine, the nicotine can when using the cigarette, in the contact with a user's skin, penetrate the skin into the blood and hence give stimulation.

8 Claims, 1 Drawing Sheet

SMOKELESS CIGARETTE

RELATED APPLICATION

This application claims priority and benefit from International Application No. PCT/SE2005/000984, filed Jun. 21, 2005, which claims priority and benefit from Swedish patent application No. 0402764-5, filed Nov. 11, 2004, the entire teachings of which are incorporated herein by reference.

TECHNICAL FIELD

The present invention relates to a cigarette that is smokeless and is suitable for antismoke purposes.

BACKGROUND OF THE INVENTION

Various means for antismoke purposes are previously known, for example nicotine tape and chewing pills containing nicotine. However, such means can give some users insufficient oral stimulation and also other insufficient body stimulation by the fact that they in use do not require that they are handled by a part of the body of a user.

SUMMARY OF THE INVENTION

It is an object of the invention to provide a cigarette that is suitable for antismoke purposes.

It is another object of the invention to provide a cigarette that when handled and used automatically provides nicotine to the blood system of a user.

It is another object of the invention to provide a cigarette that still can give, in addition to the fact that it in use is not intended to be burnt and hence create smoke gases and smoke particles, a user oral stimulation.

It is another object of the invention to provide a cigarette that is smokeless and does not provide any passive smoking.

Generally thus, a cigarette includes a part that can provide nicotine to the skin of a user, in particular the skin of the user's fingers, lips and tongue, and therefrom into the blood when she/he uses the cigarette, i.e. is holding the cigarette and is having it between her/his lips. In the conventional way the cigarette can include a mouthpiece part and a front part and the mouthpiece part can contain an inner portion permeable to air. The whole cigarette, both the mouthpiece part and the front part, are, at the substantially cylindrical envelope surface of the cigarette, advantageously enclosed by a sleeve that can be made from paper. This sleeve can then, at least in the portion thereof that is included in or surrounds the mouthpiece part, be impregnated with nicotine. The sleeve is advantageously made from a material that is not in any substantial degree permeable to air. The sleeve can then in the mouthpiece part include perforations in its region adjacent to the front part, in particular in the case where the front part itself is not permeable to air.

The front part of the cigarette can contain an inner body of a material permeable to air that is impregnated with some suitable substance, e.g. a sweet-smelling substance and/or a volatile substance having weakly antiseptic or refreshing properties. Alternatively, the inner body can itself be made from a substance pleasant to the taste, such as chewing gum, and in particular it can contain material containing sugar.

The cigarette has among other things the following advantages:

It is suited for smokers that are used to have a cigarette between their fingers and to put it in between their lips more or less automatically, since they with the cigarette as proposed herein do not have to stop this habit.

The cigarette is smokeless and thereby is avoided that the user inhales smoke since instead fresh air is inhaled, possibly having an antiseptic or refreshing substance added thereto, etc.

When using the cigarette as proposed herein the risk of lung cancer, bronchitis cancer, etc. is reduced.

In use it does not create so called passive smoking, i.e. that persons in the neighbourhood of the cigarette inhale noxious smoke and noxious particles derived from the combustion of the parts of the cigarette.

Additional objects and advantages of the invention will be set forth in the description which follows, and in part will be obvious from the description, or may be learned by practice of the invention. The objects and advantages of the invention may be realized and obtained by means of the methods, processes, instrumentalities and combinations particularly pointed out in the appended claims.

BRIEF DESCRIPTION OF THE DRAWINGS

While the novel features of the invention are set forth with particularly in the appended claims, a complete understanding of the invention, both as to organization and content, and of the above and other features thereof may be gained from and the invention will be better appreciated from a consideration of the following detailed description of non-limiting embodiments presented hereinbelow with reference to the accompanying drawings, in which:

DETAILED DESCRIPTION

Figure 1:
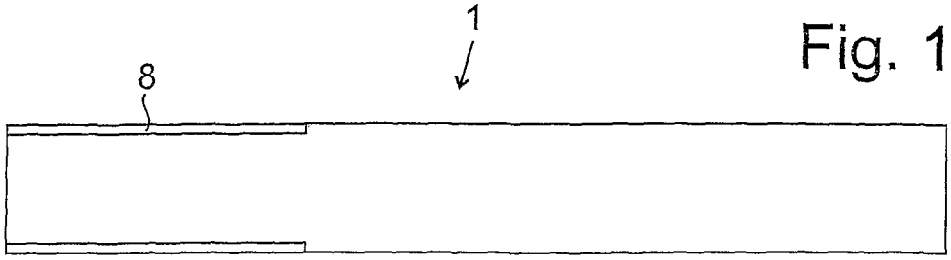
FIG. 1 is a cross-sectional view of a smokeless cigarette suited for e.g. antismoke purposes.
Figure 2:
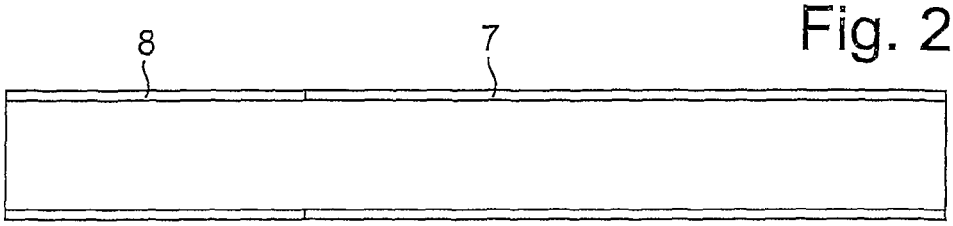
FIG. 2 is a view similar to FIG. 1 but showing a cigarette having a sleeve.
Figure 3:
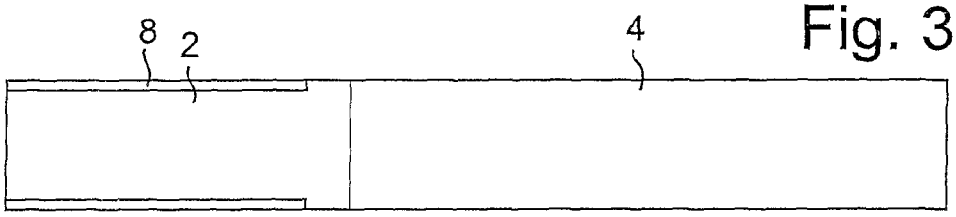
FIG. 3 is a view similar to FIG. 1 but showing a cigarette having a mouthpiece part and a front part, FIG. 4. is a view similar to FIG. 1 but showing a cigarette having a mouthpiece part permeable to air and a front part not permeable to air.
Figure 4:
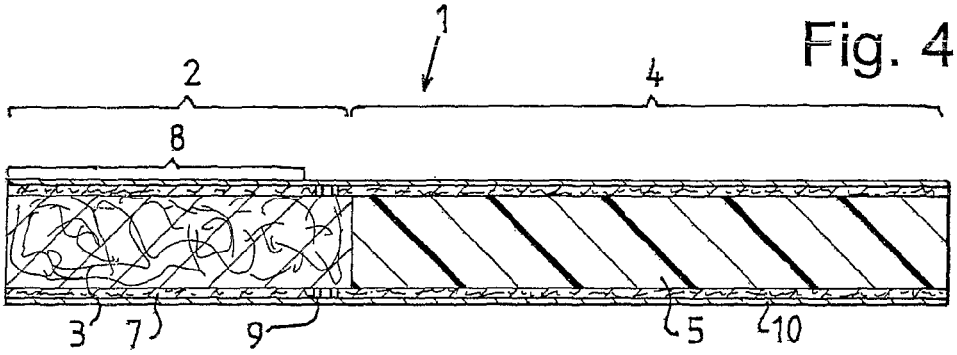
Figure 5:
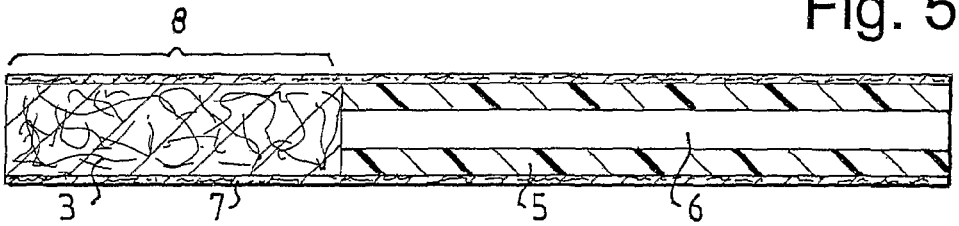
FIG. 5 is a view similar to FIG. 3 but showing a cigarette having a front part including a through-channel.
Figure 6:
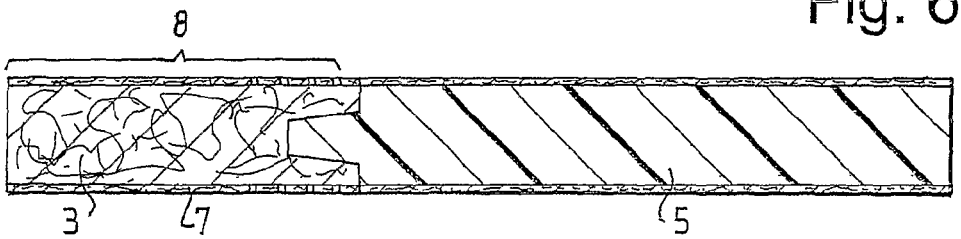
FIG. 6 is a view similar to FIG. 3 but showing a cigarette having another connection between inner portions.

In FIG. 1 a smokeless cigarette 1 is shown that is suitable for among other things antismoke purposes and includes a region 8 impregnated with nicotine or generally is so designed that it can dissipate nicotine and hence suitably contains nicotine. The region 8 is located at a place of or at portion of the cigarette where the skin of a user comes in contact with a cigarette when using it. The region can be a surface area at the envelope surface of the substantially cylindrical cigarette and it can as shown be located at one end of the cigarette. In particular the region 8 can be a portion of a surface layer 7, here also called a sleeve, made from a material that for example consists of a suitable paper material, see FIG. 2. Generally the cigarette 1 can include a mouthpiece part 2 and a front part 4, see FIG. 3. The nicotine dissipating region 8 is then advantageously located at or in the mouthpiece part. As shown in FIG. 4, the mouthpiece part 2 can have a porous inner portion or an inner body 3 that is permeable to air and is designed substantially as a filter of a filter cigarette. The front part 4 of the cigarette that corresponds to the tobacco part of a filter cigarette can then have an inner portion or an inner body 5 that possibly has a longitudinal channel 6 as shown in FIG. 5 in order to allow air to pass therethrough. The inner bodies 3, 5 are held together and are advantageously surrounded by the surface layer 7 that then in a region 8 at the mouthpiece part 2 is impregnated with nicotine. The surface layer 7 can advantageously be made of a material that is not to any substantial extent permeable to air and it can then, as shown in FIG. 4, have perforations 9 in its area close to the front part 4 in the case where the inner portion 5 of the front part of the cigarette is not permeable to air. Before use the whole cigarette can be enclosed by a thin protective film 10 of for example a polymer material that can be transparent. The protective film must be removed before use. By the impregnation of the surface layer 7 with nicotine the nicotine can, when using the cigarette, in the contact with a user's fingers, lips and tongue, penetrate the skin and into the blood of the user and hence give stimulation. Also the filter body 3 can be impregnated with nicotine. The inner bodies 3, 5 can be placed abutting each other but they can also, for enhanced mechanical strength, be designed to have larger engaging surfaces by the fact that for example one of the portions is provided with an axial hole, for example having the shape of the surface of the frustum of a cone, and the other part having a corresponding, axially protruding part having a complementary shape, such as shown in FIG. 6.

The inner portion 5 in the front part 4 of the cigarette can consist of or include material that is permeable to air such as porous material, which can be impregnated with a suitable refreshing substance pleasant to the taste or sweet-scented, for example mint oil or eucalyptus oil. Furthermore, it can consist of for example a cylindrical body of chewing gum. After the use as a cigarette the chewing gum body can then broken away from the mouthpiece part 1, be rid of the surface layer 7 and can then be used as a chewing gum. Generally, the inner body in the front part can include or consist of a substance pleasant to the taste, such as chewing gum or some substance containing sugar.

While specific embodiments of the invention have been illustrated and described herein, it is realized that numerous other embodiments may be envisaged and that numerous additional advantages, modifications and changes will readily occur to those skilled in the art without departing from the spirit and scope of the invention. Therefore, the invention in its broader aspects is not limited to the specific details, representative devices and illustrated examples shown and described herein. Accordingly, various modifications may be made without departing from the spirit or scope of the general inventive concept as defined by the appended claims and their equivalents. It is therefore to be understood that the appended claims are intended to cover all such modifications and changes as fall within a true spirit and scope of the invention. Numerous other embodiments may be envisaged without departing from the spirit and scope of the invention.

The invention claimed is:

1. A smokeless cigarette comprising a substantially cylindrical body, the substantially cylindrical body comprising:

a surface layer region that when using the cigarette is intended to come in contact with the skin of a user and that is impregnated with nicotine, so that the nicotine therein can be transferred to the skin of the user when handling and using the cigarette and therefrom into the blood system of the user, and a first inner body that is porous and permeable to air, configured substantially as a filter of a filter cigarette, and that is surrounded by the surface layer region, and wherein the cigarette comprises a filter body impregnated with nicotine, the smokeless cigarette further comprising a sleeve enclosing a substantially cylindrical envelope surface of the smokeless cigarette, the sleeve in at least one region thereof being impregnated with nicotine, said sleeve being made of a paper material.

2. The smokeless cigarette of claim 1, wherein the surface layer region extends from an end of the substantially cylindrical body over a distance so that fingers of a user when using the smokeless cigarette come in contact with the surface layer region allowing nicotine therefrom to be transferred to the skin of the fingers.

3. The smokeless cigarette of claim 1, wherein the substantially cylindrical body comprises a second inner body extending from an end of the first inner body to an end of the substantially cylindrical body.

4. The smokeless cigarette of claim 3, wherein the second inner body is of a material permeable to air that is impregnated with a sweet-scented substance.

5. The smokeless cigarette of claim 3, wherein the second inner body is of a material permeable to air that is impregnated with a volatile substance having weakly antiseptic or refreshing properties.

6. The smokeless cigarette of claim 3, wherein the second inner body is made from a substance pleasant to the taste and is releasable from the rest of the substantially cylindrical body.

7. The smokeless cigarette of claim 3, wherein the second inner body is made from chewing gum.

8. The smokeless cigarette of claim 3, wherein the second inner body is made from a substance containing sugar.

* * * * *